US011738919B2

(12) United States Patent
Huffer

(10) Patent No.: US 11,738,919 B2
(45) **Date of Patent: *Aug. 29, 2023**

(54) CONTAINER STRUCTURE WITH A BUILT-IN OPENING AND RECLOSING FEATURE

(71) Applicant: Sonoco Development, Inc., Hartsville, SC (US)

(72) Inventor: Scott William Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/715,178

(22) Filed: Apr. 7, 2022

(65) Prior Publication Data

US 2022/0227549 A1 Jul. 21, 2022

Related U.S. Application Data

(63) Continuation of application No. 17/092,749, filed on Nov. 9, 2020, now Pat. No. 11,325,759, which is a (Continued)

(51) Int. Cl.
*B65D 51/20* (2006.01)
*B65D 75/58* (2006.01)

(Continued)

(52) U.S. Cl.
CPC ..... *B65D 51/20* (2013.01); *B65D 25/54* (2013.01); *B65D 43/0235* (2013.01);

(Continued)

(58) Field of Classification Search
CPC .... B65D 65/14; B65D 43/0235; B65D 25/54; B65D 51/20
See application file for complete search history.

(56) References Cited

U.S. PATENT DOCUMENTS 1,827,636 A 10/1931 Ames
2,131,575 A 9/1938 Whipple (Continued)

FOREIGN PATENT DOCUMENTS

CA 2918375 A1 1/2015
CN 1558827 12/2004

(Continued)

OTHER PUBLICATIONS

European Communication pursuant to Article 94(3) for EP Application No. 18174601.7; dated Mar. 10, 2021, 3 pages.

(Continued)

*Primary Examiner* — Jeffrey R Allen
(74) *Attorney, Agent, or Firm* — Nelson Mullins Riley & Scarborough LLP

(57) ABSTRACT

Containers are described that allow a consumer to see inside the container and to more easily access the products. One form of the container includes a base member with a lid defining a window. A flexible laminate with a peelable flap portion is attached to the lid to provide access to the products inside. The flexible laminate includes a first film layer laminated to a second film layer. The first film layer includes a first cut line defining a peelable flap portion and the second film layer includes a second cut line offset from the first cut line that defines an opening into the container. First and second reclose surfaces defined between the cut lines on the corresponding film layers include pressure-sensitive adhesive to allow the container to be re-sealed via movement of the peelable flap portion back into engagement with the flexible laminate remaining with the container.

18 Claims, 8 Drawing Sheets

Related U.S. Application Data continuation of application No. 16/160,524, filed on Oct. 15, 2018, now Pat. No. 10,865,023, which is a continuation of application No. 14/871,398, filed on Sep. 30, 2015, now Pat. No. 10,150,600.

(60) Provisional application No. 62/058,217, filed on Oct. 1, 2014.

(51) Int. Cl.

| | |
|---|---|
| ***B65D 77/20*** | (2006.01) |
| ***B65D 25/54*** | (2006.01) |
| ***B65D 43/02*** | (2006.01) |
| ***B65D 65/14*** | (2006.01) |
| ***B65D 65/40*** | (2006.01) |
| ***B65D 85/00*** | (2006.01) |

(52) U.S. Cl.

CPC ..... *B65D 65/14* (2013.01); *B65D 65/40* (2013.01); *B65D 75/5894* (2013.01); *B65D 77/2096* (2013.01); *B65D 85/70* (2013.01); *B65D 2251/009* (2013.01); *B65D 2251/0018* (2013.01); *B65D 2251/0028* (2013.01); *B65D 2251/0093* (2013.01); *B65D 2543/00833* (2013.01); *B65D 2577/2091* (2013.01)

(56) References Cited

U.S. PATENT DOCUMENTS

| | | | |
|---|---|---|---|
| 2,861,735 | A | 11/1958 | Faltin |
| 2,952,395 | A | 9/1960 | Spees |
| 2,991,001 | A | 7/1961 | Hughes |
| 3,127,087 | A | 3/1964 | Spees |
| 3,202,271 | A | 8/1965 | Kirk |
| 3,239,097 | A | 3/1966 | Bates et al. |
| 3,259,303 | A | 7/1966 | Repko |
| 3,266,965 | A | 8/1966 | Spees |
| 3,279,331 | A | 10/1966 | Platt |
| 3,335,939 | A | 8/1967 | Robinson, Jr. |
| 3,942,640 | A | 3/1976 | Hellstrom |
| 3,946,872 | A | 3/1976 | Sturm |
| 4,023,292 | A | 5/1977 | Shibata et al. |
| 4,066,600 | A | 1/1978 | Pletcher et al. |
| 4,185,754 | A | 1/1980 | Julius |
| 4,264,662 | A | 4/1981 | Taylor et al. |
| 4,280,653 | A | 7/1981 | Elias |
| 4,325,393 | A | 4/1982 | Thomas |
| 4,345,393 | A | 8/1982 | Price et al. |
| 4,353,460 | A | 10/1982 | Kahn |
| 4,372,460 | A | 2/1983 | Brochman et al. |
| 4,381,848 | A | 5/1983 | Kahn |
| 4,452,842 | A | 6/1984 | Borges et al. |
| 4,464,158 | A | 8/1984 | Kardon |
| 4,502,599 | A | 3/1985 | Perecman |
| 4,531,668 | A | 7/1985 | Forbes, Jr. |
| 4,574,952 | A | 3/1986 | Masui |
| 4,584,201 | A | 4/1986 | Boston |
| 4,679,693 | A | 7/1987 | Forman |
| 4,738,365 | A | 4/1988 | Prater |
| 4,785,940 | A | 11/1988 | Wilson |
| 4,838,429 | A | 6/1989 | Fabisiewicz et al. |
| 4,846,504 | A | 7/1989 | MacGregor et al. |
| 4,871,265 | A | 10/1989 | Peck |
| 4,913,560 | A | 4/1990 | Herrington |
| 5,044,776 | A | 9/1991 | Schramer et al. |
| 5,123,535 | A | 6/1992 | Patnode et al. |
| 5,235,149 | A | 8/1993 | Boehrerk |
| 5,246,106 | A | 9/1993 | Johnson |
| 5,265,794 | A | 11/1993 | Johnston |
| 5,415,910 | A | 5/1995 | Knauf |
| 5,484,167 | A | 1/1996 | Donaldson et al. |
| 5,507,428 | A | 4/1996 | Robinson, Jr. et al. |
| 5,569,515 | A | 10/1996 | Rice, II et al. |
| 5,571,358 | A | 11/1996 | Napier et al. |
| 5,832,145 | A | 11/1998 | Dais et al. |
| 5,833,368 | A | 11/1998 | Kaufman |
| 5,855,435 | A | 1/1999 | Chiesa |
| 5,871,096 | A | 2/1999 | Yakich |
| 5,902,045 | A | 5/1999 | Resteghini |
| 5,910,348 | A | 6/1999 | Hart-Smith et al. |
| 5,947,368 | A | 9/1999 | Thresher et al. |
| 5,958,486 | A | 9/1999 | Ringdahl et al. |
| 5,979,748 | A | 11/1999 | Drummond et al. |
| 6,026,853 | A | 2/2000 | Osterbrink |
| 6,026,953 | A | 2/2000 | Nakamura et al. |
| 6,041,929 | A | 3/2000 | Brunner et al. |
| 6,047,488 | A | 4/2000 | Tuskiewicz |
| 6,056,141 | A | 5/2000 | Navarini et al. |
| 6,190,485 | B1 | 2/2001 | Cahill et al. |
| 6,196,450 | B1 | 3/2001 | Varadarajan et al. |
| 6,206,570 | B1 | 3/2001 | Cortopassi |
| 6,234,386 | B1 | 5/2001 | Drummond et al. |
| 6,264,098 | B1 | 7/2001 | Drummond et al. |
| 6,270,004 | B1 | 8/2001 | Drummond et al. |
| 6,302,321 | B1 | 10/2001 | Reese et al. |
| 6,328,203 | B1 | 12/2001 | Tedford, Jr. |
| 6,334,711 | B1 | 1/2002 | Risgalla et al. |
| 6,383,592 | B1 | 5/2002 | Lowry et al. |
| 6,428,867 | B1 | 8/2002 | Scott et al. |
| 6,460,720 | B1 | 10/2002 | Massey et al. |
| 6,497,336 | B2 | 12/2002 | Grayer |
| 6,544,613 | B1 | 4/2003 | Varadarajan |
| 6,589,622 | B1 | 7/2003 | Scott |
| 6,620,275 | B1 | 9/2003 | Avila et al. |
| 6,660,353 | B2 | 12/2003 | Siedl |
| 6,746,743 | B2 | 1/2004 | Knoerzer et al. |
| 6,857,561 | B2 | 2/2005 | Williams et al. |
| 6,858,108 | B2 | 2/2005 | Matthews et al. |
| 6,890,112 | B2 | 5/2005 | Kline |
| 6,991,375 | B2 | 1/2006 | Clune et al. |
| 7,144,635 | B2 | 12/2006 | Hawes et al. |
| 7,189,300 | B2 | 3/2007 | Knoerzer et al. |
| 7,228,961 | B2 | 6/2007 | Koetter et al. |
| 7,344,744 | B2 | 3/2008 | Sierra-Gomez et al. |
| 7,416,768 | B2 | 8/2008 | Knoerzer et al. |
| 7,422,782 | B2 | 9/2008 | Haedt et al. |
| 7,608,317 | B2 | 10/2009 | Keckeisen et al. |
| 7,686,513 | B2 | 3/2010 | Knoerzer et al. |
| 7,717,620 | B2 | 5/2010 | Hebert et al. |
| 7,789,236 | B2 | 9/2010 | Burgess |
| 7,789,262 | B2 | 9/2010 | Niederer et al. |
| 7,828,923 | B2 | 11/2010 | Patel |
| 7,955,678 | B2 | 6/2011 | Stogbauer et al. |
| 8,051,979 | B2 | 11/2011 | Smith et al. |
| 8,408,451 | B2 | 4/2013 | Adam et al. |
| 8,443,578 | B2 | 5/2013 | Sargin et al. |
| 8,544,718 | B2 | 10/2013 | Yamato et al. |
| 8,646,975 | B2 | 2/2014 | Moehlenbrock et al. |
| 8,740,052 | B2 | 6/2014 | Drummond |
| 8,746,490 | B2 | 6/2014 | Huffer et al. |
| 9,096,346 | B2 | 8/2015 | Huffer |
| 9,278,506 | B2 | 3/2016 | McLean |
| 9,783,354 | B2 | 10/2017 | Rhue |
| 9,802,746 | B2 | 10/2017 | Rhue |
| 9,850,056 | B2 | 12/2017 | Shaw et al. |
| 9,928,757 | B2 | 3/2018 | Huffer et al. |
| 10,026,339 | B2 | 7/2018 | Huffer et al. |
| 10,138,026 | B2 | 11/2018 | Branyon |
| 10,150,600 | B2 | 12/2018 | Huffer |
| 2003/0178429 | A1 | 9/2003 | Williams et al. |
| 2004/0013827 | A1 | 1/2004 | Zuser et al. |
| 2004/0064983 | A1 | 4/2004 | Joseph |
| 2004/0079763 | A1 | 4/2004 | Powell et al. |
| 2005/0031814 | A1 | 2/2005 | Dawes |
| 2005/0078890 | A1 | 4/2005 | Abe et al. |
| 2005/0109652 | A1 | 5/2005 | Goepfert |
| 2005/0153113 | A1 | 7/2005 | Hseih et al. |
| 2005/0276525 | A1 | 12/2005 | Hebert et al. |
| 2006/0138207 | A1 | 6/2006 | Levine et al. |
| 2006/0147129 | A1 | 7/2006 | Miller |
| 2006/0198986 | A1 | 9/2006 | Keckeisen et al. |
| 2007/0051790 | A1 | 3/2007 | Smith et al. |
| 2008/0037911 | A1 | 2/2008 | Cole et al. |

(56) References Cited

U.S. PATENT DOCUMENTS

| | | | |
|---|---|---|---|
| 2008/0044114 | A1 | 2/2008 | Hall et al. |
| 2008/0073308 | A1 | 3/2008 | Yousif |
| 2008/0190937 | A1 | 8/2008 | Cho |
| 2008/0240627 | A1 | 10/2008 | Cole et al. |
| 2008/0272016 | A1 | 11/2008 | Anderson et al. |
| 2009/0078671 | A1 | 3/2009 | Triquet et al. |
| 2009/0194451 | A1 | 8/2009 | Leiner et al. |
| 2009/0226117 | A1 | 9/2009 | Davis et al. |
| 2009/0274799 | A1 | 11/2009 | Lee et al. |
| 2010/0019022 | A1 | 1/2010 | Ryan et al. |
| 2010/0098355 | A1 | 4/2010 | Jansen |
| 2010/0111453 | A1 | 5/2010 | Dierl |
| 2010/0147724 | A1 | 6/2010 | Mitra-Shah et al. |
| 2010/0288760 | A1 | 11/2010 | McGrew et al. |
| 2010/0032313 | A1 | 12/2010 | Bostian et al. |
| 2011/0038569 | A1 | 2/2011 | Huffer et al. |
| 2011/0049168 | A1 | 3/2011 | Loftin |
| 2011/0089177 | A1 | 4/2011 | Thorstensen-Wolf |
| 2011/0204056 | A1 | 8/2011 | Veternik et al. |
| 2012/0082764 | A1 | 4/2012 | Paterson |
| 2012/0125932 | A1 | 5/2012 | Sierra-Gomez et al. |
| 2012/0177307 | A1 | 7/2012 | Duan et al. |
| 2012/0314979 | A1 | 12/2012 | Heininga |
| 2013/0026170 | A1 | 1/2013 | Zerfas et al. |
| 2013/0056470 | A1 | 3/2013 | Hallak |
| 2013/0089280 | A1 | 4/2013 | Tseng et al. |
| 2013/0101239 | A1 | 4/2013 | Kropf et al. |
| 2013/0114918 | A1 | 5/2013 | Lyzenga et al. |
| 2013/0121624 | A1 | 5/2013 | Lyzenga et al. |
| 2013/0011527 | A1 | 10/2013 | Renders et al. |
| 2013/0279832 | A1 | 10/2013 | Burri et al. |
| 2013/0320019 | A1 | 12/2013 | Tinoco et al. |
| 2014/0000219 | A1 | 1/2014 | Pezzoli |
| 2014/0079343 | A1 | 3/2014 | Lyzenga et al. |
| 2014/0270597 | A1 | 9/2014 | Friedman et al. |
| 2014/0363545 | A1 | 12/2014 | Veternik et al. |
| 2014/0376836 | A1 | 12/2014 | Schieber |
| 2015/0158643 | A1 | 6/2015 | Coker et al. |
| 2015/0297005 | A1 | 10/2015 | Janor |
| 2015/0353238 | A1 | 12/2015 | Moehlenbrock et al. |
| 2016/0009447 | A1 | 1/2016 | Rhue |
| 2016/0096667 | A1 | 4/2016 | Huffer |
| 2016/0122109 | A1 | 5/2016 | Clark |
| 2016/0130041 | A1 | 5/2016 | Giorgio et al. |
| 2016/0167680 | A1 | 7/2016 | Tomsovic et al. |
| 2016/0227835 | A1 | 8/2016 | Swede |
| 2016/0236844 | A1 | 8/2016 | Gagne et al. |
| 2016/0288960 | A1 | 10/2016 | Branyon |
| 2016/0343275 | A1 | 11/2016 | Huffer et al. |
| 2017/0121086 | A1 | 5/2017 | Hartley |
| 2017/0121088 | A1 | 5/2017 | Rhue |
| 2017/0283149 | A1 | 10/2017 | Rhue |
| 2017/0345344 | A1 | 11/2017 | Huffer et al. |
| 2018/0244452 | A1 | 8/2018 | Huffer |
| 2018/0293918 | A1 | 10/2018 | Huffer et al. |
| 2019/0023452 | A1 | 1/2019 | Huffer |

FOREIGN PATENT DOCUMENTS

| | | | |
|---|---|---|---|
| DE | 8903067 | | 7/1989 |
| EP | 0 488 967 | | 6/1992 |
| EP | 0499647 | B1 | 1/1995 |
| EP | 0952087 | A2 | 10/1999 |
| EP | 1080874 | | 3/2001 |
| EP | 1477408 | A1 | 11/2004 |
| EP | 1537990 | A2 | 6/2005 |
| EP | 1770025 | A2 | 4/2009 |
| FR | 1514374 | A | 2/1968 |
| FR | 2 463 468 | A1 | 2/1981 |
| GB | 2147564 | A | 5/1985 |
| GB | 2491646 | A | 12/2012 |
| JP | 2000 203654 | A | 7/2000 |
| JP | 2013 147269 | A | 8/2013 |
| KR | 20140103638 | A | 8/2014 |
| WO | WO 95/29097 | A1 | 11/1995 |
| WO | WO 96/25333 | A1 | 8/1996 |
| WO | WO 98/28728 | A1 | 7/1998 |
| WO | WO 03/062090 | A1 | 7/2003 |
| WO | WO 2006/093898 | A1 | 9/2006 |
| WO | WO 2006/132761 | A2 | 12/2006 |
| WO | WO 2008/086389 | A2 | 7/2008 |
| WO | WO 2011/158014 | A1 | 12/2011 |
| WO | WO 2012/036765 | A1 | 3/2012 |
| WO | WO 2014/186571 | A2 | 11/2014 |
| WO | WO 2015/009658 | A2 | 1/2015 |

OTHER PUBLICATIONS

"Tamper-evidence: Consumers have come to expect tamper-evidence for drugs, foods"; Packaging (Boston, Mass); Mar. 19, 1989; vol. 34, No. 5 (3 pgs.).

"Innovations for opening and closing"; Food Trade Review; Oct. 1993; vol. 63, No. 4 (3 pgs.).

Kate Bertrand; "Improve security through packaging: emerging technologies can help create a package that safeguards products from tampering and protects your brand from counterfeiting"; Food Processing; Feb. 2006; vol. 67, No. 2 (5 pgs.).

LPS Industries, Loc n Press Pressure Sensitive Zippered Envelopes, www.lpsind.com, accessed Apr. 1, 2015.

ITC, Custom Adhesive Tape Manufacturing & Design, www.itctapes.com, accessed Feb. 2, 2015.

ClearBags, Value Crystal Clear Bags, www.clearbags.com, accessed Apr. 1, 2015.

Office Action for corresponding Canadian Patent Application No. 2,847,432 dated Nov. 25, 2014.

Final Office Action for U.S. Appl. No. 14/928,489 dated Mar. 22, 2018.

Non-Final Office Action for U.S. Appl. No. 14/676,390 dated Apr. 27, 2018.

Non-final Office Action for U.S. Appl. No. 14/871,398 dated May 5. 2019.

Canadian Patent Application No. 3,006,160, filed May 25, 2018, Canadian Office Action dated Apr. 2, 2019.

Canadian Patent Application No. 3,006,160, filed May 25, 2018, Canadian Office Action dated Dec. 31, 2019.

International Search Report and Written Opinion for International Application No. PCT/IB2015/057508 dated Nov. 19, 2015.

International Search Report and Written Opinion of the International Searching Authority for International Application No. PCT/US2017/064594 dated Mar. 27, 2018.

International Search Report and Written Opinion of the International Searching Authority for International Application No. PCT/US2018/054170 dated Dec. 6, 2018.

Extended European Search Report for Application No. 18174641.3 dated Sep. 10, 2018.

Non-Final Office Actin for U.S. Appl. No. 15/807,200 dated Nov. 18, 2019.

European Examination Report for European Application No. 18174641.3 dated Oct. 9, 2019.

Non-Final Office Action for U.S. Appl. No. 15/807,200 dated May 31, 2019.

Canadian Exam Report for Application No. 2925682, dated Aug. 25, 2022, 4 pages. (Art has been previously cited in this application.)

May 2, 2018 Office Action issued in U.S. Appl. No. 14/871,398.

Jul. 26, 2018 Extended European Search Report issued in European Patent Application No. 18174601.7.

Jul. 28, 2016 Extended European Search Report issued in European Patent Application No. 16165679.8.

Jan. 11, 2017 Office Action issued in Canadian Patent Application No. 2,927,049.

Jul. 19, 2016 Office Action issued in European Patent Application No. 15 175 851.3.

Nov. 11, 2015 Search Report issued in European Patent Application No. 15 175 851.3.

Jun. 14, 2016 Office Action issued in U.S. Appl. No. 14/328,305.

Sep. 8, 2016 Office Action issued in U.S. Appl. No. 14/328,305.

(56) References Cited

OTHER PUBLICATIONS

Nov. 8, 2016 Office Action issued in Chinese Patent Application No. 201510402006.6.
Mar. 29, 2017 Office Action issued in Chinese Patent Application No. 201510402006.6.
Nov. 25, 2016 Notice of Allowance issued in U.S. Appl. No. 14/328,305.
Apr. 19, 2017 Office Action issued in U.S. Appl. No. 15/408,620.
Jun. 6, 2017 Notice of Allowance issued in U.S. Appl. No. 15/408,620.
Oct. 8, 2019 Office Action issued in U.S. Appl. No. 15/442,779.
Oct. 9, 2019 Examination Report issued in European Patent Application No. 18174601.7.
Jul. 11, 2016 Search Report issued in European Patent Application No. 16163438.1.
May 1, 2020 Notice of Allowance issued in U.S. Appl. No. 16/008,513.
Oct. 1, 2018 Notice of Allowance issued in U.S. Appl. No. 14/871,398.
Apr. 30, 2020 Office Action issued in U.S. Appl. No. 15/442,779.
Mar. 10, 2020 Office Action issued in U.S. Appl. No. 15/807,200.
Jan. 24, 2018 Office Action issued in Canadian Patent Application No. 2,963,215.
U.S. Appl. No. 15/442,779 entitled "Resealable Flexible Packaging" filed Feb. 27, 2017.
U.S. Appl. No. 15/656,481 entitled "Tamper Evident Hybrid Resealable Container" filed Jul. 21, 2017.
U.S. Appl. No. 15/807,200 entitled "Membrane Lid With Integrated Peelable Portion" filed Nov. 8, 2017.
U.S. Appl. No. 15/676,167 entitled "Flexible Laminate for Packaging with Integrated Peelable Portion" filed Aug. 14, 2017.
Apr. 8, 2022 European Communication pursuant to Article 94(3) for EP Application No. 18174601.7.
Non Final Office Action issued in U.S. Appl. No. 17/523,282 dated Dec. 22, 2022; 27 pages.

CONTAINER STRUCTURE WITH A BUILT-IN OPENING AND RECLOSING FEATURE

CROSS-REFERENCE TO RELATED APPLICATIONS

This application is a continuation of U.S. patent application Ser. No. 17/092,749, filed Nov. 9, 2020, which is a continuation of U.S. patent application Ser. No. 16/160,524, filed Oct. 15, 2018, which is a continuation of U.S. patent application Ser. No. 14/871,398, filed Sep. 30, 2015, which claims the benefit of U.S. Provisional Application No. 62/058,217 entitled "Container Structure with a Built-In Opening and Reclosing Feature," filed Oct. 1, 2014, all of which are incorporated herein in their entirety.

BACKGROUND

This invention relates to containers for holding products, and particularly relates to providing mechanisms for reclosing the containers to continue storing the products after the container has been initially opened.

Containers can be used to store various types of products. In some cases, for example, a flexible film-based lidding is sealed to a thermoformed tray to hold the product within the container. To open the container, the consumer must typically pierce the lidding with a sharp object, such as a knife, to create an opening that provides access to the product, or must otherwise remove the lidding from the tray to gain access. In other cases, product may be stored within a paperboard box or carton. To dispense the product from the carton, the consumer typically must open the side flaps of the box structure.

Many times, the contents of the container are not consumed in one sitting, and leftover product may need to be stored for future use.

BRIEF SUMMARY

Embodiments of the invention described herein provide improved containers for storing products and associated methods that allow the consumer to see the product held therein before opening the container (e.g., when deciding whether to purchase the products) and also allow the consumer to reclose the container after it has been opened so as to keep any remaining portion of the contents securely stored therein for future consumption. In some embodiments, a container for storing products is provided that includes a base member and a flexible laminate. The base member may include a base, four sidewalls, and a lid that define a storage cavity, wherein the storage cavity is configured to hold products therein, and wherein the lid defines a window. The flexible laminate may be configured to be attached to the lid of the base member so as to cover the window and, in cooperation with the base, four sidewalls, and lid, enclose and maintain the products within the container.

The flexible laminate may include a first film layer and a second film layer laminated to the first film layer. The first film layer may comprise a first cut line defining a peelable flap portion, and the second film layer may comprise a second cut line offset from the first cut line and defining an opening providing access into the storage cavity. The first film layer may form a first reclose surface between the first and second cut lines, and the second film layer may form a second reclose surface between the first and second cut lines. At least one of the first or second reclose surfaces may include pressure-sensitive adhesive to allow the peelable flap portion to be re-sealed to a remainder of the flexible laminate so as to reclose the opening when the first reclose surface is brought into engagement with the second reclose surface via movement of the peelable flap portion.

In some cases, the base member may comprise a folded carton made of paperboard. Additionally or alternatively, the first film layer of the flexible laminate may comprise polyethylene terapthalate (PET) and the second film layer of the flexible laminate may comprise oriented polypropylene (OPP).

The flexible laminate may be attached to an outer surface of the lid of the base member, or the flexible laminate may be attached to an inner surface of the lid of the base member. The lid of the base member, in some cases, may define an extension overlying a pull tab of the peelable flap portion, where the extension serves as a tamper evident feature. The extension may comprise at least one line of weakness, and each line of weakness may be configured to be cut by a user to gain access to the pull tab.

In some embodiments, one of an outer surface or an inner surface of the lid of the base member may be coated with low density polyethylene (LDPE), and the flexible laminate may be heat sealed to a respective one of the outer surface or the inner surface. In other embodiments, the flexible laminate may be glued to one of an outer surface or an inner surface of the lid of the base member.

In some cases, the flexible laminate may be transparent, such that the products stored within the container are viewable by the consumer. The lid of the base member may have a width and a length corresponding to a width and a length of the container, and the window defined by the lid may have a width and a length that are smaller than the width and the length of the lid, respectively. The container may be configured for holding pet products, such as pet food and/or pet toys.

The first and second film layers may be laminated to each other via pattern-applied permanent adhesive and pressure-sensitive adhesive. In some embodiments, the first cut line may comprise a first side portion, a second side portion, and an intermediate portion extending therebetween, and the first and second side portions may include free ends that are spaced apart. Additionally or alternatively, the second cut line may form a closed shape. The first cut line may define a pull tab portion.

In other embodiments, a method of making a container for storing products is provided. A base member may be formed, where the base member comprises a base, four sidewalls, and a lid that define a storage cavity. The storage cavity may be configured to hold products therein. A window may be defined in the lid of the base member. A flexible laminate may be formed by creating a first cut line in a first film layer, wherein the first cut line defines a peelable flap portion; creating a second cut line in a second film layer, wherein the second cut line defines an opening providing access into the storage cavity; and laminating the first film layer to the second film layer. The flexible laminate may be attached to the lid of the base member so as to cover the window and, in cooperation with the base, four sidewalls, and lid, enclose and maintain the products within the container.

The first film layer may form a first reclose surface between the first and second cut lines, and the second film layer may form a second reclose surface between the first and second cut lines. At least one of the first or second reclose surfaces may include pressure-sensitive adhesive to allow the peelable flap portion to be re-sealed to a remainder of the flexible laminate so as to reclose the opening when the first reclose surface is brought into engagement with the second reclose surface via movement of the peelable flap portion.

In some cases, the first cut line may define a pull tab portion and the flexible laminate may be attached to an inner surface of the lid of the base member. An extension of the lid of the base member may be defined that overlies the pull tab of the peelable flap portion, and the extension may serve as a tamper evident feature. In some embodiments, at least one line of weakness may be defined in the extension, where each line of weakness may be configured to be cut by a user to gain access to the pull tab.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1:
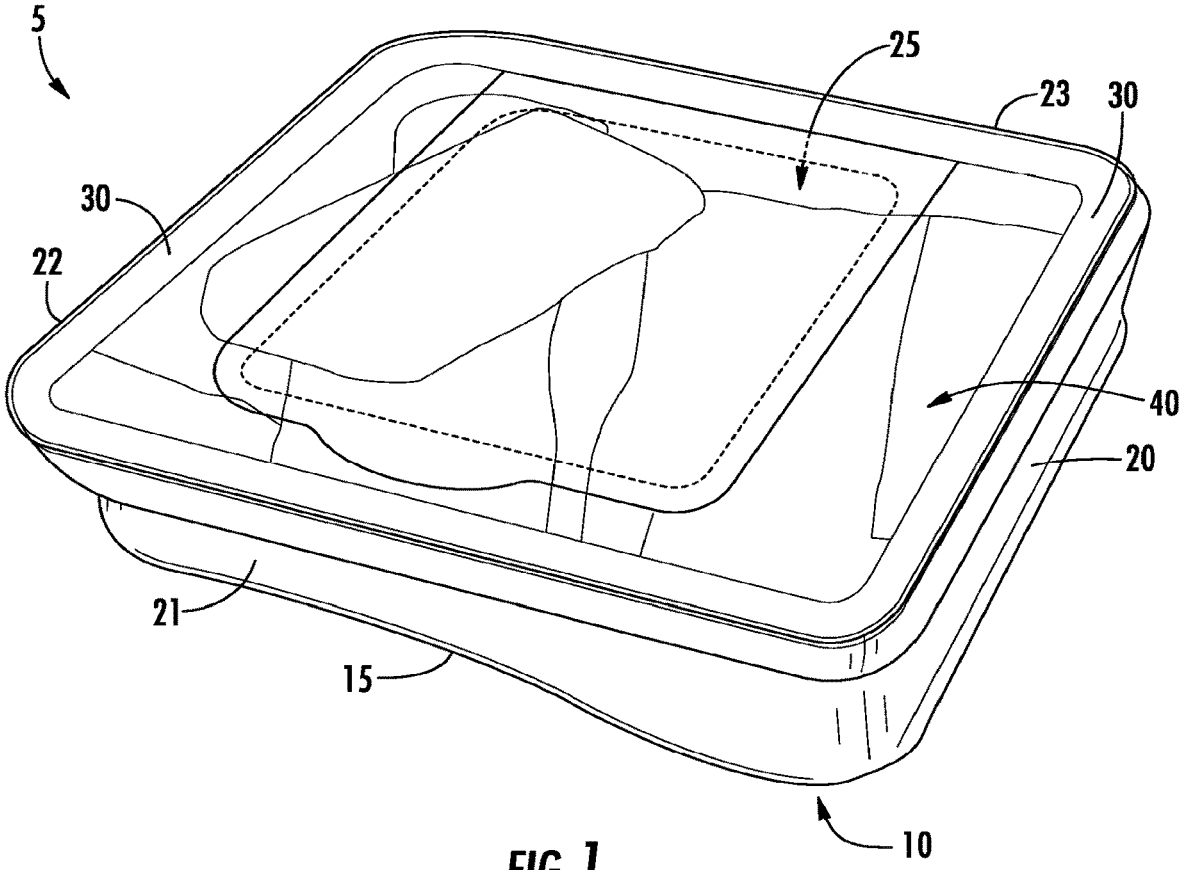
FIG. 1 is a perspective view of a container in a closed configuration according to an example embodiment.

The present invention now will be described more fully hereinafter with reference to the accompanying drawings in which some but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

As noted above, some containers for holding products (e.g., cookies, snacks, pet food products, and non-food products, such as pet toys), are sometimes designed to be rigid for aesthetic and/or marketing reasons, to allow for easier stacking on shelves or for transport, and/or to provide better support and resistance to damage to the products held therein in the event the container is hit or otherwise subjected to a force or impact. In some cases, for example, a thermoformed tray may be provided to hold the products within the container, and a flexible film-based lidding may be sealed to the base member to keep the contents inside. To open such containers, the consumer may need to pierce the lidding with a sharp object, such as a knife, to create an opening that provides access to the product. Using a knife or other sharp object to cut through the flexible film according to conventional solutions may put the consumer at risk of injuring himself or inadvertently damaging the products held inside the container. Alternatively, the consumer may be required to remove the lidding from the tray by peeling off the film. In conventional scenarios, however, in which the film is typically heat-sealed to the thermoformed tray, the force required to separate the film from the edge of the tray may be large, and the consumer may risk spilling the contents of the container when the film is finally separated from the tray due to the large amount of force used to gain access. Moreover, once opened, there is no easy way to reclose the container, such that any products that are unused can remain stored within the container in a secure fashion.

In other conventional cases, products may be stored within a paperboard box or carton. The carton may, in some cases, have a clear flexible film forming part of the container to allow a consumer to see the products held within the opaque carton. To dispense the products from the carton, the consumer typically must open the side flaps of the box structure. Again, a knife or other sharp object may be needed to separate the side flaps and gain access to the products held inside. When less than the entire contents of the container are consumed, the unused products may be returned to the carton, and the flaps may be reengaged in an effort to keep the contents inside. Although the side flaps in some conventional cartons may theoretically be designed to reengage each other to close the carton, the engagement may be loose or less than secure, and a conscientious consumer may need to apply additional adhesive tape to the side flaps to keep them together, making the reclosed package less aesthetically pleasing and complicating future openings of the container.

Embodiments of the container described herein therefore provide a way to hold products in a secure, aesthetically pleasing fashion, while allowing a consumer to both see inside the container to inspect the products held therein and to access the products in an easy-to-open, reclosable manner.

Figure 2:
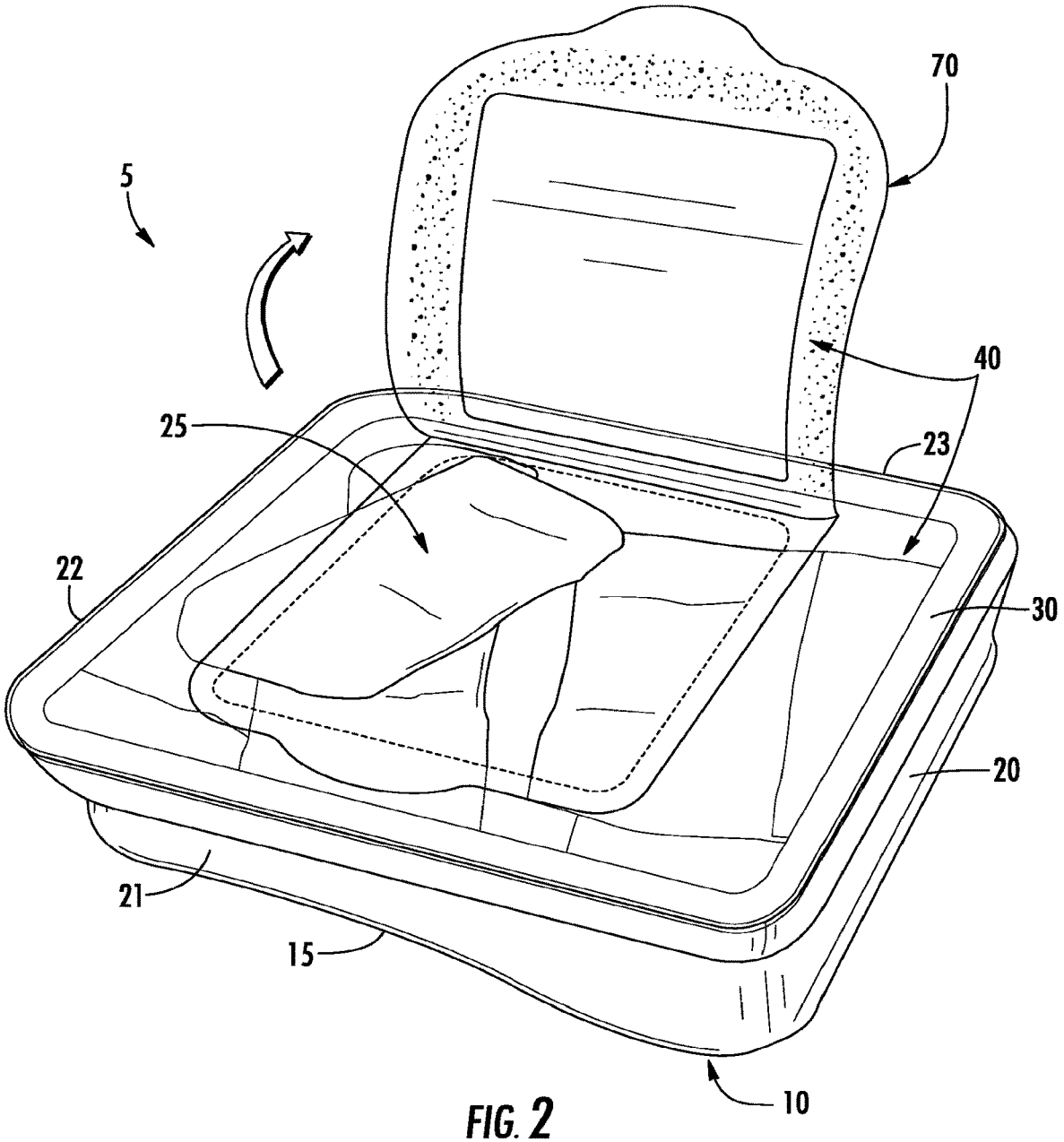
FIG. 2 is a perspective view of the container of FIG. 1 in an open configuration according to an example embodiment.

FIGS. 1 and 2, for example, depict a container 5 according to one embodiment, in which a base member 10 is provided that includes a base 15 and four sidewalls 20, 21, 22, 23 that together define a storage cavity 25. The base member 10 may be, for example, a thermoformed tray and may define a flange 30 extending outwardly from the sidewalls 20, 21, 22, 23. The container 5 may further include a flexible laminate 40 that is configured to be attached to the base member 10. For example, the flexible laminate 40 may be heat sealed or otherwise permanently adhered to a corresponding surface of the flange 30, as shown in FIGS. 1 and 2.

Although the flexible laminate 40 may be permanently attached to the base member 10 of the container 5 via the flange 30, the flexible laminate may be structured such that portions of the film layers forming the laminate are selectively separable from each other when a peelable flap portion 70 is moved away from the base member 10, as shown in FIG. 2. Thus, peeling of the peelable flap portion 70 away from the base member 10, in the direction of the arrow depicted in FIG. 2, serves to create an opening into the container that is reclosable. The flexible laminate 40 shown in FIGS. 1 and 2 is structured according to embodiments of the invention, as described in greater detail with respect to FIGS. 3-7, below.

Figure 3:
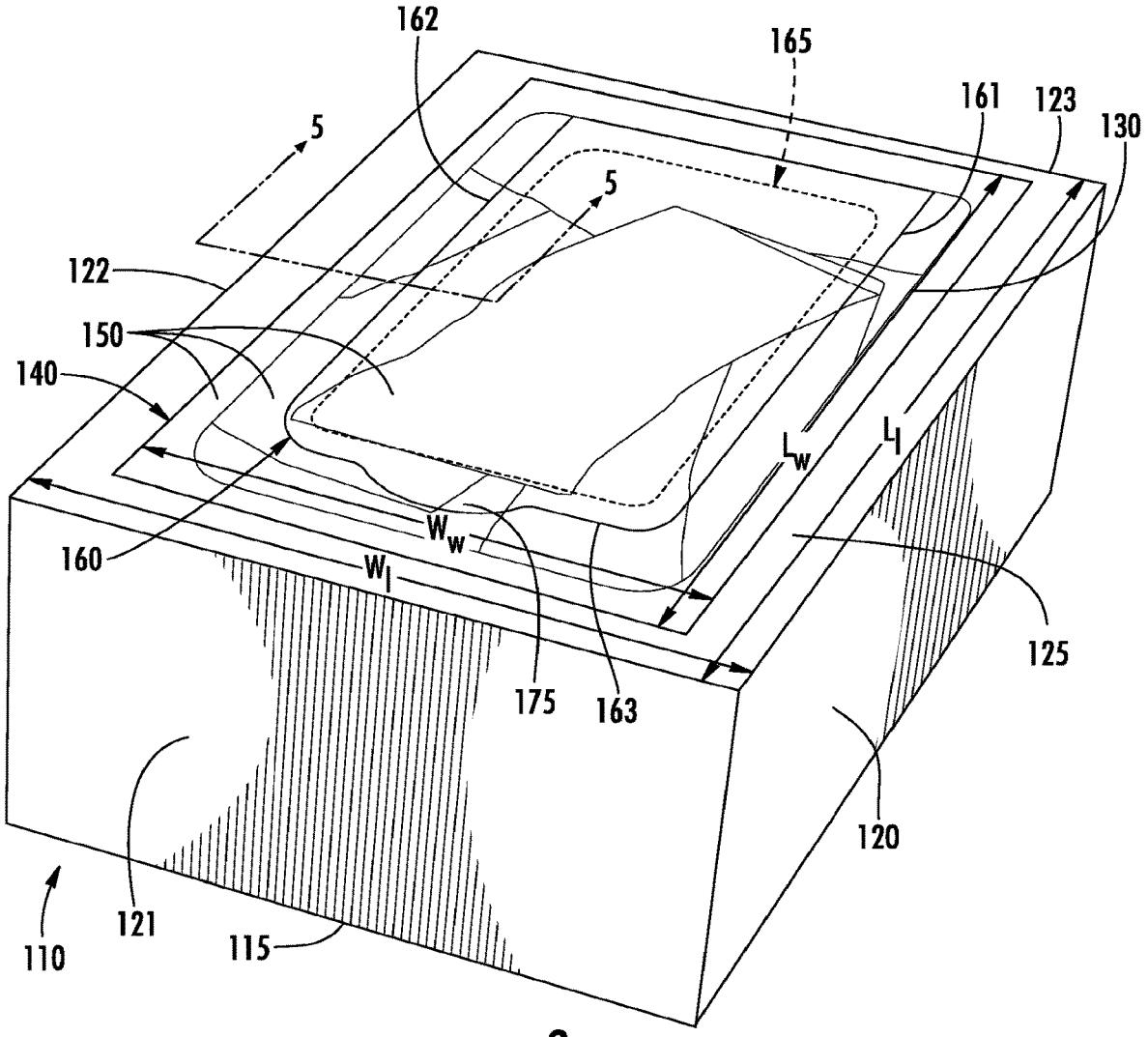
FIG. 3 is a perspective view of a container in a closed configuration according to another example embodiment.
Figure 4:
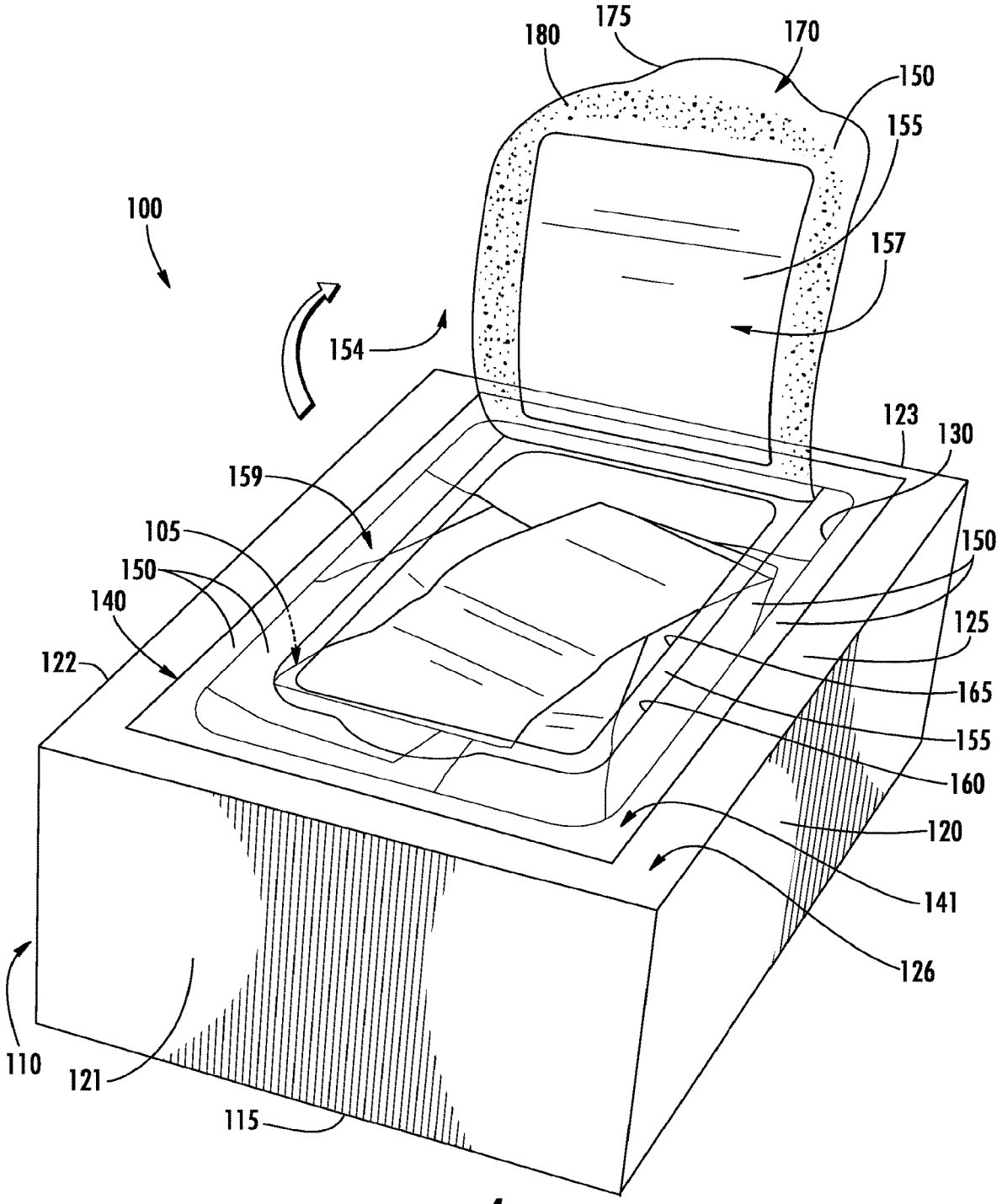
FIG. 4 is a perspective view of the container of FIG. 3 in an open configuration according to an example embodiment.

Turning to FIGS. 3 and 4, for example, another embodiment of the container is provided in which the container 100 is in the form of a box. The container 100 according to the embodiments of FIGS. 3 and 4 may comprise a base member 110 that includes a base 115, four sidewalls 120, 121, 122, 123, and a lid 125 that define a storage cavity 105. The storage cavity 105 may be configured to hold products 135, such as snacks, baked goods, or other food items for human consumption, or pet products, such as pet food and pet toys, therein.

The lid 125 may define a window 130, which may, in some embodiments, be an opening cut into the lid material. A flexible laminate 140 may be attached to the lid 125 of the base member 110 so as to cover the window 130. The flexible laminate 140 may, in cooperation with the base 115, four sidewalls 120, 121, 122, 123, and lid 125, enclose and maintain the products 135 held within the container 100. At the same time, in embodiments in which the base member 110 comprises a folded carton made of paperboard and is opaque, a flexible laminate 140 made of transparent materials (e.g., clear films) may be used to allow the consumer to see into the container without necessitating that the container be opened, as shown in FIG. 3.

Figure 6:
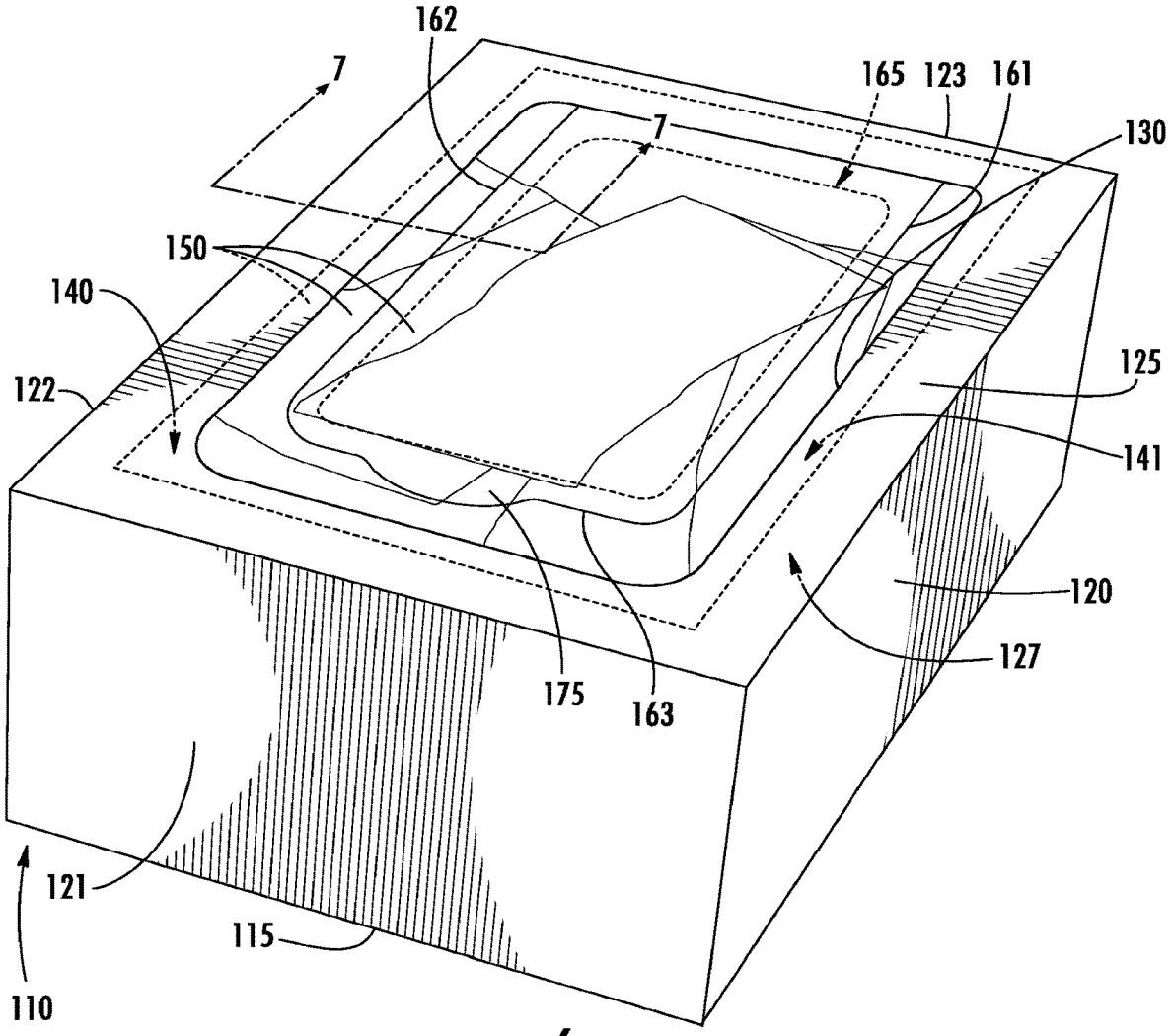
FIG. 6 is a perspective view of a container in a closed configuration according to another example embodiment.
Figure 7:
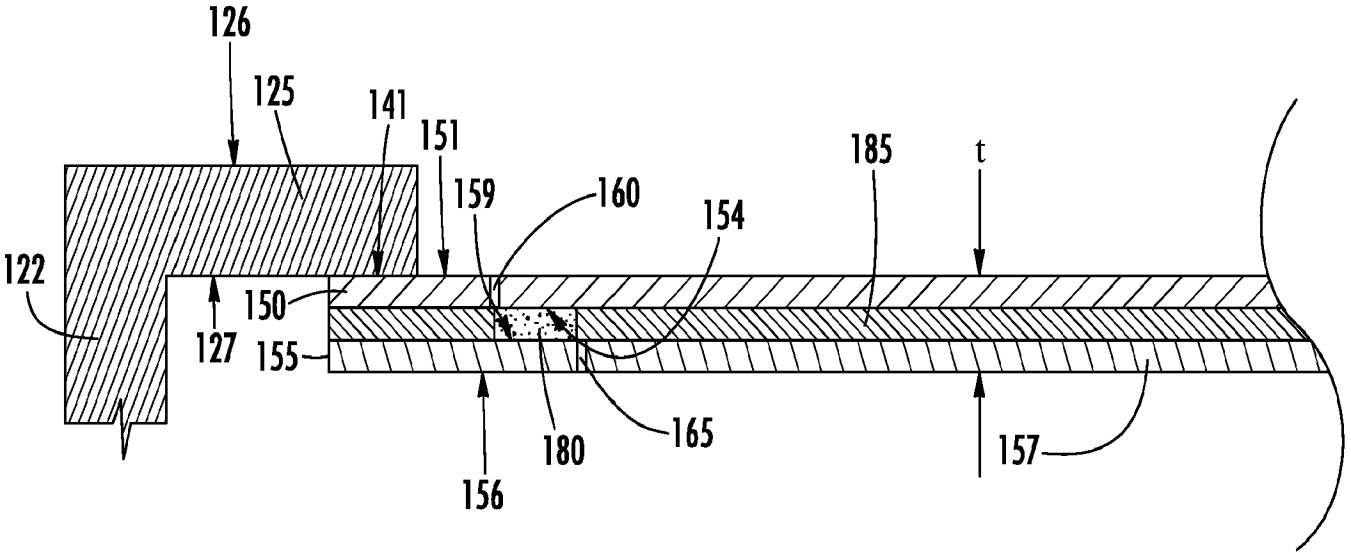
FIG. 7 is a partial cross-sectional view of the flexible laminate of FIG. 6 according to an example embodiment.

The window 130 defined in the lid 125 of the base member 110 may have various configurations (e.g., sizes and/or shapes), depending on the particular application, such as based on market considerations (e.g., depending on the type of products stored in the container and what the relevant consumer may find to be a preferable configuration for the window). In FIGS. 3, 4, and 6, for example, the window 130 is rectangular; however, in other embodiments, the window may be circular, oval, or trapezoidal, and in still other embodiments the window may have an irregular shape, such as a shape representing a shape of the products held therein (e.g., a dog bone shape). Because the window 130 is defined in the lid 125 of the base member 110, the window is generally smaller than a nominal size of the lid. For example, with reference to FIG. 3, the lid 125 of the base member 110 may have a width Wi and a length Li that generally correspond to a width and a length of the container 100, and the window 130 defined by the lid may have a width $W_w$ and a length $L_w$ that are smaller than the width and the length of the lid, respectively.

The flexible laminate 140 may be structured to include a first film layer 150 (e.g., on an outer surface of the flexible laminate) and a second film layer 155 (e.g., on an inner surface of the flexible laminate, visible in FIG. 4). The second film layer 155 may be laminated to the first film layer 150 as described in greater detail below. The first film layer 150 may include a first cut line 160 that defines a peelable flap portion 170, and the second film layer 155 may include a second cut line 165 that defines an opening providing access into the storage cavity 105. Thus, in the depicted embodiment, the peelable flap portion 170 may be moved away from the remainder of the flexible laminate 140 that remains attached to the lid 125 of the base member 110 (e.g., in the direction of the arrow in FIG. 4). As the peelable flap portion 170 is lifted away, such as via a pull tab 175 that is grippable by the user, a portion 157 of the second film layer 155 that is permanently adhered (e.g., via permanent adhesive 185, shown in FIG. 5) to the portion of the first film layer 150 defining the peelable flap portion 170 is also lifted away from the container so as reveal the opening defined by the second cut line 165, as shown in FIG. 4.

Figure 5:
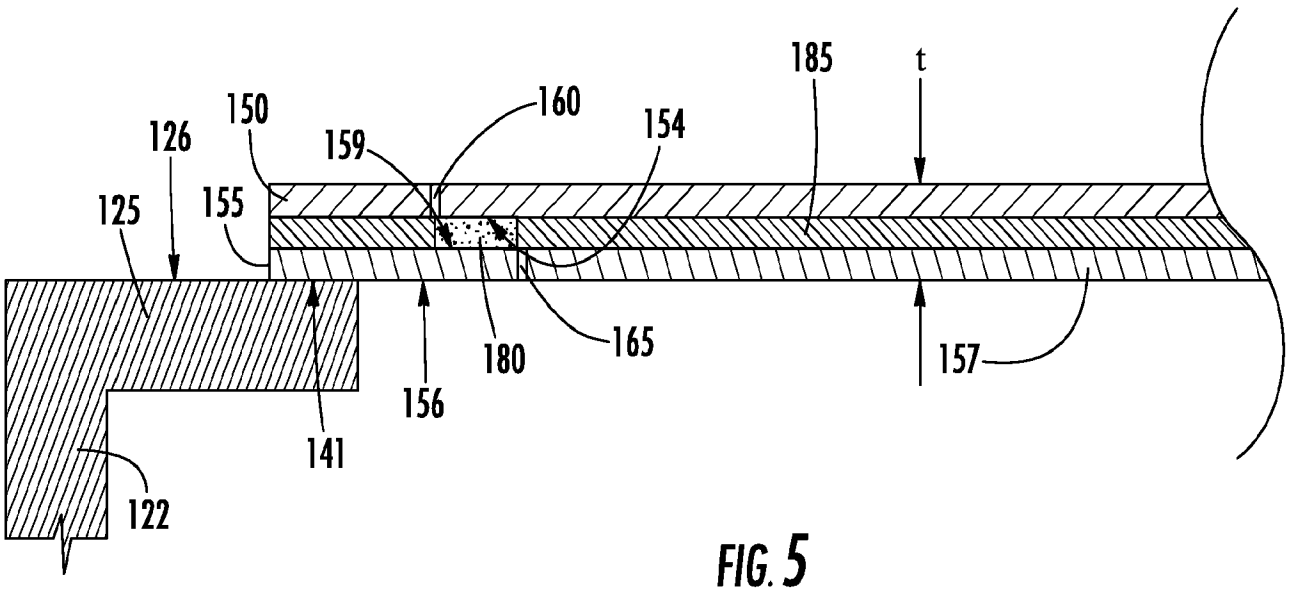
FIG. 5 is a partial cross-sectional view of the container of FIGS. 3 and 5 according to an example embodiment.

As illustrated in FIGS. 3 and 4, the first and second cut lines 160, 165 may thus be offset from each other, rather than aligned, with respect to a thickness of the flexible laminate 140. A cross-section of the flexible laminate 140 is illustrated in FIG. 5, showing the first and second cut lines 160, 165 being offset from each other with respect to the thickness t of the film. The offset configuration of the first and second cut lines 160, 165 is such that the first film layer 150 forms a first reclose surface 154 between the first and second cut lines, and the second film layer 155 forms a second reclose surface 159 between the first and second cut lines. In some embodiments, at least one of the first or second reclose surfaces 154, 159 may include pressure-sensitive adhesive 180 (illustrated in FIG. 5) to allow the peelable flap portion to be re-sealed to a remainder of the flexible laminate so as to reclose the opening when the first reclose surface 154 is brought into engagement with the second reclose surface 159 via movement of the peelable flap portion 170 (e.g., in a direction opposite that shown by the arrow in FIG. 4). In some embodiments, for example, the first and second film layers 150, 155 may be laminated to each other via pattern-applied permanent adhesive 185 and pressure-sensitive adhesive 180, as illustrated in FIG. 5 in cross-section.

The first and second cut lines 160, 165 may be configured (e.g., sized and shaped) in various ways, such as based on functional, performance, aesthetic, and manufacturing considerations. In some embodiments, such as those shown in FIGS. 3-7, the first cut line 160 may comprise a first side portion 161, a second side portion 162, and an intermediate portion 163 extending between the first and second side portions, as depicted in FIG. 3. As illustrated, the first and second side portions 161, 162 may include free ends that are spaced apart, such that the first cut line 160 generally has a U-shape, with the uncut portion extending between the two free ends (e.g., opposite the intermediate portion 163) forming a fold or hinge line about which the peelable flap portion 170 can be moved. In some embodiments, the second cut line 165 may, in turn, form a closed shape, such as a rounded rectangle, as shown. Accordingly, when the peelable flap 170 is fully opened, the shape of the resulting opening into the container 100 may have a corresponding rounded rectangle shape (shown in FIG. 4). In other embodiments, however, the second cut line 165 may have a non-closed shape, such as a shape corresponding to the shape of the first cut line 160 (e.g., a U-shape). In such cases, the opening defined into the container 100 may be bounded along one edge by the hinge line defined by the first cut line 160.

Moreover, as noted above, in some cases the first cut line 160 may define a pull tab 175, such as a protrusion or rounded outward extension from the general shape of the first cut line 160 that provides an area that the consumer can grip and use to pull the peelable flap portion 170 away from the container 100. The area between the first and second film layers 150, 155 corresponding to the location of the pull tab 175 may, in some cases, be devoid of permanent or pressure-sensitive adhesive, such that a consumer can easily separate the first film layer 150 from the second film layer 155 in the region of the pull tab 175 for peeling the peelable flap portion 170 away from the container 100.

The flexible laminate 140 may be attached to the base member 110 in various ways. According to the embodiment shown in FIGS. 3 and 4, for example, the flexible laminate 140 may be attached to an outer surface 126 of the lid 125 of the base member 110. Thus, in the embodiment depicted in FIGS. 3 and 4 and shown in cross-section in FIG. 5, an inner surface 156 of the second film layer 155 of the flexible laminate 140 is attached to the outer surface 126 of the lid 125 of the base member 110. A peripheral region 141 of the flexible laminate 140 may, for example, overlap a corresponding area of the outer surface 126 of the lid 125 and may be attached thereto. In such embodiments, the entirety of the flexible laminate 140 may be disposed outside the container 100.

In other embodiments, such as the embodiment depicted in FIG. 6, the flexible laminate 140 may be attached to an inner surface 127 of the lid 125 of the base member 110. Thus, in the embodiment depicted in FIG. 6 and in cross-section in FIG. 7, an outer surface 151 of the first film layer 150 of the flexible laminate 140 is attached to the inner surface 127 of the lid 125 of the base member 110. The peripheral region 141 of the flexible laminate 140, in this case, may overlap a corresponding area of the inner surface 127 of the lid 125, inside the container, and may be attached thereto. Accordingly, in such embodiments, the peripheral region 141 of the flexible laminate 140 would not be visible to the consumer, and the only portion of the flexible laminate 140 visible to the consumer would be the portion disposed within (e.g., bounded by) the window 130 of the lid 125. Although in the depicted embodiments the flexible laminate 140 is shown as being smaller that the width $W_l$ and the length $L_l$ of the lid 125 of the base member 110, in other embodiments, not shown, the flexible laminate may be cut to have the same or approximately the same dimensions as the lid.

Figure 8:
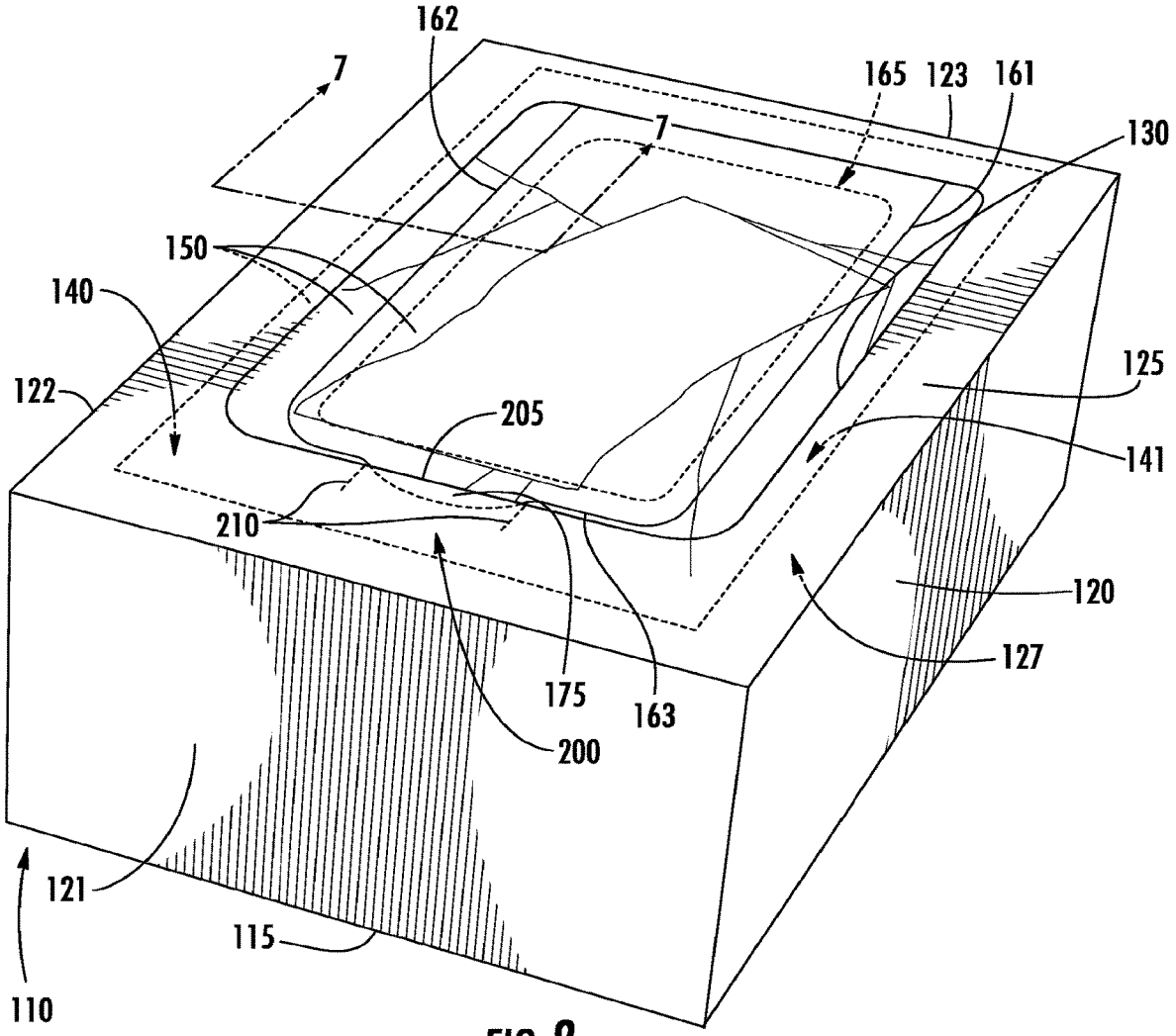
FIG. 8 is a perspective view of a container having a tamper evident feature in a closed configuration according to another example embodiment.
Figure 9:
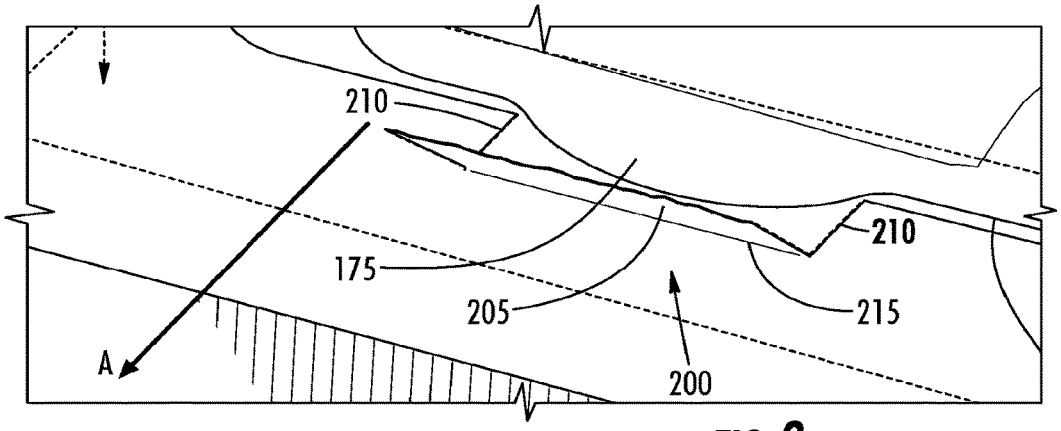
FIG. 9 is a partial close-up view of the tamper evident feature of FIG. 8 with the underlying pull tab of peelable flap portion accessible to the user according to another example embodiment.

In some embodiments, shown in FIGS. 8 and 9, the container 100 may include a tamper evident feature 200 configured to allow a user to detect whether the container has been previously opened, such as whether the peelable flap portion 170 has been moved away from the container 100 via the pull tab 175 to provide access to the products stored therein and subsequently reattached via the pressure-sensitive adhesive (e.g., the pressure-sensitive adhesive 180 shown in FIG. 4). For example, as described in connection with FIGS. 6 and 7, the flexible laminate 140 may be attached to an inner surface 127 of the lid 125 of the base member 110. The tamper evident feature 200 may be formed by an extension 205 of the lid 125 over the pull tab 175 of the peelable flap portion 170. The extension 205 may thus be configured to be separated from the lid 125 to provide access to the pull tab 175, where such separation of the extension 205 is visually detectable by the user.

For example, the extension 205 may define one or more lines of weakness 210 that are configured to be torn by the user to provide access to the pull tab 175. As shown in FIG. 9, for example, a user may pull back on the extension 205 in the direction A, which may in turn cause a tear in the material of the lid 125 along the lines of weakness 210. In the embodiment of FIGS. 8 and 9, for example, two lines of weakness 210 are provided that are substantially parallel to each other. The material of the lid 125 and/or the extension 205 may be paperboard, and the lines of weakness 210 may comprise perforations in some cases. The pull tab 175 may be disposed beneath the extension 205, between the two lines of weakness 210, such that when the extension is pulled back by the user in the direction A, the lines of weakness are torn through and create a fold line 215 extending between the two lines of weakness. With the extension 205 pulled back in this way, the pull tab 175 may be exposed, and the user may be able to grip the pull tab and open the peelable flap portion 170 as described above with respect to other embodiments. Because separation of the extension 205 tears the material of the lid 125 along the lines of weakness 210 and creates a fold line 215, however, the fact that the container 100 has been opened is readily apparent to the user, even if the peelable flap portion 170 is resealed in the closed configuration via the pressure-sensitive adhesive.

The materials of the first and second film layers 150, 155 may vary, and in some cases a coating or skin layer may need to be applied to the corresponding surface of the lid 125 of the base member 110 to facilitate attachment of the flexible laminate 140 thereto. For example, in some embodiments, the first film layer 150 of the flexible laminate 140 may comprise polyethylene terephthalate (PET), and the second film layer 155 of the flexible laminate 140 may comprise oriented polypropylene (OPP). In embodiments in which the flexible laminate 140 is heat sealed to the lid 125, a corresponding one of the outer surface 126 or the inner surface 127 of the lid 125 of the base member 110 (e.g., depending on whether the flexible laminate is to be attached to the outer surface, as shown in FIGS. 3 and 4, or to the inner surface, as shown in FIG. 6) may be poly-coated, such as by coating it with a low density polyethylene (LDPE). Moreover, a corresponding surface of a respective one of the first or second film layers 150, 155 may also include a heat seal coating, such as a polyethylene (PE) emulsion. Other heat seal coatings may include polypropylene, ionomer resins, acrylic, or other coatings. In other embodiments, however, the flexible laminate 140 may be glued to a respective one of the outer surface 126 or the inner surface 127 of the lid 125 of the base member 110 (e.g., via hot melt glue).

Embodiments of a method of making a container for storing products is also provided, in which a flexible laminate structured as described above to have a built-in opening and reclose function is attached to a base member, such as the base member 10 of FIGS. 1 and 2 or the base member 110 of FIGS. 3-7. For example, with respect to the embodiments of FIGS. 3-7, a base member comprising a base, four sidewalls, and a lid that define a storage cavity may be formed, and the storage cavity may be configured to hold products therein, as described above. A window may be defined in the lid of the base member, such as by cutting a hole or opening into the material of the lid. In other embodiments, such as embodiments depicted in FIGS. 1 and 2, the base member may be formed by thermoforming a tray.

The flexible laminate may be constructed as a multi-layer structure by adhesively laminating a first film layer to a second film layer. In some embodiments, the flexible laminate may be constructed as described in U.S. Pat. No. 7,717,620, which is incorporated by reference.

Permanent and pressure-sensitive adhesives may be applied to one of the film layers in predetermined patterns. Once the laminate is formed in this manner, scoring operations may be performed on both sides of the laminate in registration with the adhesive patterns, but each scoring operation may penetrate only through a part of the thickness of the laminate. In particular, a scoring operation performed on the side of the laminate adjacent the first film layer may result in penetration through the first film layer, but without complete penetration through the second film layer, and preferably without any substantial penetration, and more preferably without any penetration, into the second film layer. Likewise, the scoring operation performed on the side of the laminate adjacent the second film layer may result in penetration through the second film layer, but without complete penetration through the first film layer, and preferably without any substantial penetration, and more preferably without any penetration, into the first film layer.

In some cases, one of the first or second film layers may be printed (or reverse-printed) before being laminated to the other film layer, for example to include information regarding the products stored within the container. Prior to printing, the surface of the respective film layer may be treated (e.g., by a corona discharge or flame treatment) to render the surface more-receptive to the inks and/or may be treated to render the surface more-readily bondable to the pressure-sensitive adhesive that is subsequently pattern-applied to the surface, as described below.

In this regard, a pressure-sensitive adhesive may be applied to the first layer in a predetermined pattern that recurs at regular intervals along the lengthwise direction of the first film layer (e.g., to make a length of laminate that will be cut to fit a number of containers). The predetermined pattern may be generally in the form of a strip of various forms or shapes. For example, in embodiments in which the first cut line of the first film layer (e.g., first cut line 160 of FIG. 3) has a U-shape, the strip pattern of the pressure-sensitive adhesive may be generally U-shaped; however, other shapes for the pattern can be used as appropriate for the particular application. The pattern can, in some cases, include a region that is free of adhesive and will ultimately form a pull tab, such as the pull tab 175 of FIG. 3.

The pressure-sensitive adhesive can comprise various compositions. Pressure-sensitive adhesives form viscoelastic bonds that are aggressively and permanently tacky, adhere without the need of more than a finger or hand pressure, and require no activation by water, solvent, or heat. Pressure-sensitive adhesives are often based on non-cross-linked rubber adhesives in a latex emulsion or solvent-borne form, or can comprise acrylic and methacrylate adhesives, styrene copolymers (SIS/SBS), and silicones. Acrylic adhesives are known for excellent environmental resistance and fast-setting time when compared with other resin systems. Acrylic pressure-sensitive adhesives often use an acrylate system. Natural rubber, synthetic rubber or elastomer sealants and adhesives can be based on a variety of systems such as silicone, polyurethane, chloroprene, butyl, polybutadiene, isoprene, or neoprene. When the packaging laminate of the invention is to be used for food packaging, the pressure-sensitive adhesive generally must be a food-grade composition. Additives (e.g., particulates or the like) can be added to the pressure-sensitive adhesive to reduce the tenacity of the bond to the underlying second film layer, if necessary, so that the pressure-sensitive adhesive will readily detach from the second film layer on opening (particularly on the very first opening).

A permanent laminating adhesive may then be applied to the first film layer in such a manner that a sufficiently large proportion of the surface is covered by the permanent adhesive to permit the first film layer to be adhesively attached to a second film layer at a downstream laminating station. The permanent adhesive may be applied to areas of the first film layer surface that are not covered by the pressure-sensitive adhesive. Furthermore, when the pattern of pressure-sensitive adhesive includes an adhesive-free region to form a pull tab, as previously noted, the pattern of the permanent adhesive would also exclude the adhesive-free region.

Following lamination as described above, the laminate may be advanced to a first scoring station at which the first cut line is formed through the thickness of the first film layer. The first cut line may be made such that it is in registration with (e.g., coincides with) the outer perimeter of the strip-shaped pattern of pressure-sensitive adhesive to define the shape of the peelable flap portion described above. Next, the laminate may be advanced to a second scoring station at which a second cut line is formed through the thickness of the second film layer. The second cut line may be made such that is in registration with (e.g., coincides with) the inner perimeter of the strip-shaped pattern of pressure-sensitive adhesive, thereby defining the shape of the opening into the container as described above. The relative locations of the cut lines 160, 165 with respect to the pressure-sensitive adhesive 180 are illustrated in cross-sections in FIGS. 5 and 7.

The first and/or second cut lines may be made in various ways, such as via a laser that is synchronized with the advancement of the laminate in a manner as described above. A sensor may be provided that can detect a feature, such as an eye mark, on the laminate whose location in relation to the pressure-sensitive adhesive strip is known, and the sensor output can be used for regulating the laser operation so that the second cut line is in registration with the inner perimeter of the pressure-sensitive adhesive strip.

As an alternative to the use of lasers for scoring the laminate, the cut lines can be formed in the laminate by mechanical scoring or cutting. For instance, a kiss roll and a backing roll may be used to form a nip through which the laminate is passed. The kiss roll may comprise a rotary cutting die defining a cutting edge.

The flexible laminate may then be attached to the lid of the base member (e.g., the base member 10, 110 shown in FIGS. 1-7) to form the completed container. The flexible laminate 140 may, for example, be attached to the lid 125 of the base member 110 (FIGS. 3-7) so as to cover the window 130, such as via heat seals, hot melt glue, or other suitable methods. In this way, the flexible laminate 140 may cooperate with the base 115, four sidewalls 120, 121, 122, 123, and lid to enclose and maintain the products within the container. As described above, the first film layer 150 may thus form a first reclose surface 154 between the first and second cut lines 160, 165, and the second film layer 155 may form a second reclose surface 159 between the first and second cut lines.

In some embodiments, the first reclose surface 154 of the first film layer 150 has a greater affinity for bonding with the pressure-sensitive adhesive 180 than does the second reclose surface 159 of the second film layer 155, and hence the pressure-sensitive adhesive can be detached from the second surface 159 of the second film layer and remains attached to the first reclose surface 154 shown in FIGS. 3-7. The container is reclosable by moving the peelable flap portion towards the container to bring the first reclose surface into engagement with the second reclose surface to re-attach the pressure-sensitive adhesive (and first film layer 15) to the second reclose structure 159 of the inner film layer.

The greater bonding affinity of the first film layer can be achieved in various ways. For example, when the first film layer comprises of PET and the second film layer comprises a polyolefin such as polypropylene, OPP, or metallized OPP, the PET will naturally have a greater affinity for bonding to the adhesive than will the polyolefin layer. Additionally or alternatively, the surface of the first film layer can be treated, as previously noted, by corona discharge or flame treatment, to increase the surface energy and enhance the bonding affinity. It is also possible, as already noted, to control the bond strength of the pressure-sensitive adhesive to the first film layer by including an additive in the adhesive to reduce the bond strength, if desired.

Although in some embodiments the pressure-sensitive adhesive may be applied to the first film layer and may remain on the first film layer upon opening, as described above and depicted in the figures, in other embodiments the pressure-sensitive adhesive may be applied to the second film layer and may remain on the second film layer upon opening.

Many other modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container for storing products comprising:

a paperboard base member comprising a base, at least one sidewall extending upwardly from the base, and a lid which extends inwardly from the at least one sidewall, wherein the base, at least one sidewall and lid define a cavity and wherein the lid defines a window; and a flexible laminate configured to be attached to the lid of the base member so as to cover the window and, in cooperation with the base, at least one sidewall, and lid, enclose the container, wherein the flexible laminate comprises:

a first film layer, and a second film layer laminated to the first film layer, wherein the first film layer comprises a first cut line defining a peelable flap portion and a pull tab portion and the second film layer comprises a second cut line offset from the first cut line and defining an opening providing access into the cavity, wherein the first film layer forms a first reclose surface between the first and second cut lines, and the second film layer forms a second reclose surface between the first and second cut lines, wherein at least one of the first or second reclose surfaces includes pressure-sensitive adhesive to allow the peelable flap portion to be re-sealed to a remainder of the flexible laminate so as to reclose the opening when the first reclose surface is brought into engagement with the second reclose surface via movement of the peelable flap portion; and wherein a portion of the lid overlies the pull tab of the peelable flap portion and wherein the peelable flap portion is smaller than the window.

2. The container of claim 1, wherein at least one line of weakness is defined in the overlying portion of the lid.

3. The container of claim 2, wherein the at least one line of weakness comprises perforations.

4. The container of claim 2, wherein the at least one line of weakness is configured to be torn to gain access to the pull tab.

5. The container of claim 1, wherein the overlying portion of the lid is configured to be at least partially separated from the lid.

6. The container of claim 5, wherein such separation of the overlying portion of the lid is visually detectable.

7. The container of claim 1, wherein the overlying portion of the lid serves as a tamper evident feature.

8. The container of claim 1, wherein at least two lines of weakness are defined in the overlying portion of the lid.

9. The container of claim 8, wherein the at least two lines of weakness are parallel to each other.

10. The container of claim 8, wherein the pull tab is disposed beneath the overlying portion of the lid, disposed between the at least two lines of weakness.

11. The container of claim 8, wherein each of the at least two lines of weakness extend from an edge of the lid toward the at least one sidewall.

12. The container of claim 11, wherein two lines of weakness are defined in the overlying portion of the lid and when the overlying portion of the lid is pulled by a user, the at least two lines of weakness are torn and create a fold line extending between the two lines of weakness nearest the at least one sidewall.

13. The container of claim 1, wherein the paperboard base comprises a folded carton.

14. The container of claim 1, wherein the paperboard base is opaque.

15. The container of claim 1, wherein the window and the peelable flap portion are transparent.

16. The container of claim 1, wherein the window is smaller than the lid.

17. The container of claim 1, wherein the flexible laminate is heat sealed to the base.

18. The container of claim 1, wherein the flexible laminate is attached to an inner surface of the lid of the base member.

* * * * *